US007520696B2

(12) United States Patent
Pihl

(10) Patent No.: US 7,520,696 B2
(45) Date of Patent: Apr. 21, 2009

(54) VEHICLE FOR INSTALLING A CABLE IN A GROUND FORMATION

(75) Inventor: Hans Pihl, Vlissingen (NL)

(73) Assignee: Seatools B.V., Numansdorp (NL)

( * ) Notice: Subject to any disclaimer, the term of this patent is extended or adjusted under 35 U.S.C. 154(b) by 0 days.

(21) Appl. No.: 11/740,675

(22) Filed: Apr. 26, 2007

(65) Prior Publication Data

US 2007/0253780 A1 Nov. 1, 2007

(30) Foreign Application Priority Data

Apr. 28, 2006 (EP) ..... 06113314

(51) Int. Cl.
*F16L 1/16* (2006.01)

(52) U.S. Cl. ..... 405/161; 405/159

(58) Field of Classification Search ..... 405/158, 405/159, 160, 161, 162, 164, 165, 180, 183
See application file for complete search history.

(56) References Cited

U.S. PATENT DOCUMENTS

| | | | | |
|---|---|---|---|---|
| 3,434,297 | A | 3/1969 | Gretter et al. | |
| 3,540,226 | A | 11/1970 | Sherrod | |
| 3,608,322 | A | 9/1971 | Kinnan et al. | |
| 3,898,852 | A * | 8/1975 | Ezoe et al. | 405/164 |
| 3,966,169 | A | 6/1976 | Schosek | |
| 4,087,981 | A * | 5/1978 | Norman | 405/161 |
| 4,103,501 | A | 8/1978 | Laurent | |
| 4,664,553 | A * | 5/1987 | Grinsted et al. | 405/164 |
| 4,877,355 | A * | 10/1989 | Van Pelt | 405/158 |
| 5,722,793 | A | 3/1998 | Peterson | |
| 6,095,721 | A * | 8/2000 | Von Benzon | 405/180 |
| 6,116,818 | A * | 9/2000 | Bitetto et al. | 405/164 |
| 6,273,642 | B1 * | 8/2001 | Anderson | 405/163 |

FOREIGN PATENT DOCUMENTS

| | | | |
|---|---|---|---|
| DE | 19542689 | C1 | 4/1997 |
| FR | 2388094 | | 11/1978 |
| GB | 2014538 | | 8/1979 |
| SU | 588308 | A1 | 1/1978 |
| WO | 0060178 | A1 | 10/2000 |
| WO | 2004055276 | A1 | 7/2004 |

OTHER PUBLICATIONS

Extended European Search Report, 2006.

* cited by examiner

*Primary Examiner*—Frederick L Lagman
(74) *Attorney, Agent, or Firm*—Knoble, Yoshida & Dunleavy, LLC

(57) ABSTRACT

A vehicle (1) for installing a cable (2) in a ground formation, in particular in a seabed, comprising a frame (3), propulsion means (4, 6), a cutter assembly (8) for forming a trench and a guide (15) for placing the cable (2) in the trench. The guide (2) is releasably connected to the vehicle (1). The vehicle and guide according to the present invention facilitate installing a cable in a ground formation, in particular in a seabed, as well as interrupting installation.

16 Claims, 2 Drawing Sheets

VEHICLE FOR INSTALLING A CABLE IN A GROUND FORMATION

BACKGROUND OF THE INVENTION

1. Field of the Invention

The invention relates to a vehicle for installing a cable in a ground formation, in particular in a seabed, comprising a frame, propulsion means, a cutter assembly for forming a trench and a guide for placing the cable in the trench. The invention also relates to the guide itself and to a method of temporarily interrupting the installation of a cable.

2. Brief Description of the State of the Art

Vehicles of this type are often referred to as "cable trenching machines" or simply "trenchers" and are known in the art.

WO 00/60178 discloses a method of forming a trench at sea on the seabed comprising the steps of providing an ROV (remotely operable vehicle) (2) capable of being operated underwater, providing a separate trenching skid (1) removably connectable to the ROV (2), connecting the trenching skid (1), possibly via an interface skid (3), to the ROV to form an operative trenching system (1, 2, 3), the connection being capable of being made while the trenching skid (1) is on the seabed, and operating the trenching system to form a trench underwater.

U.S. Pat. No. 5,722,793 discloses a method comprising the steps of using a self-propelled cable-burying tractor (1) remotely controlled via a flexible control umbilical (2) and provided with at least one drum (6) for a flexible cable (7), controlling said cable-burying tractor from a first location (5) in order to lay and bury the flexible cable as far as a first predetermined point (P1), controlling said cable-burying tractor beyond said first predetermined point from a second location (10), and continuing to lay and bury the flexible cable as far as a second predetermined point (P2), one of said locations being on land (5) while the other is a surface vessel (10). It is stated in U.S. Pat. No. 5,722,793 that this method is particularly suitable for laying and burying flexible cables such as optical cables, coaxial cables for analogue transmission, electrical cables and single or multiple flexible tubular ducts.

WO 2004/055276 discloses an apparatus for forming a trench (16) in the surface of the earth (15), for example a trench for energy lines, communication lines, etc., which apparatus comprises a frame (1) provided with propulsion means (2, 3), on which frame at least one trench forming device (5) is mounted. The trench-forming device (5) comprises at least one driveable drill bit (6), whose axis of rotation is oriented substantially parallel to the direction of movement of the apparatus during operation of the apparatus.

If the installation of a cable must be interrupted and the trencher hoisted, e.g. because of weather conditions or a malfunction of the trencher or the surface vessel from which the trencher is operated, the cable, which must, as a matter of course, remain on the seabed when the trencher is hoisted, is likely to slide into the trench and/or the trench is likely to cave in. Further, it will be difficult to locate the correct section of the cable and resume trenching.

BRIEF SUMMARY OF THE INVENTION

It is an object of the present invention to provide an improved vehicle for installing a cable in a ground formation.

To this end, the vehicle according to the present invention is characterised in that the guide is releasably connected to the vehicle.

To be able to more accurately position the guide with respect to the trench and/or to maintain the relative position at least in lateral direction, i.e. typically in the centre of the trench, it is preferred in general (i.e. even if the guide is permanently attached to the vehicle) that the guide is moveable with respect to the vehicle, preferably in lateral direction and in height.

It is further preferred that the guide is provided with a keel, preferably having a width less than or equal to the width of the cutters. By placing the keel in the trench, maintaining proper alignment with the trench is further facilitated. Also, the keel will keep the guide in place and stabilise the trench when the guide is disconnected from the vehicle.

In another embodiment, the guide comprises a curved wall for laterally shifting the cable towards the trench. To prevent excessive strain on the cable, it is preferred that the wall has a radius of curvature of at least 20 times the diameter of the cable, i.e. if the cable has a diameter of 15 cm, the radius of the wall is preferably at least 3 meters.

The vehicle and guide according to the present invention facilitate installing a cable in a ground formation, in particular in a seabed, as well as interrupting installation.

The invention also relates to a method of temporarily interrupting the installation, by means of the vehicle and guide described above, of a cable in a seabed, including the steps of:

disconnecting the vehicle from the guide while leaving the cable in or on the guide, hoisting the vehicle by means of a surface vessel and leaving the guide in position and preferably at least partly in or on the trench, lowering, after e.g. removing the cause for the interruption, the vehicle from the surface vessel, preferably to the location of the guide and preferably over the cable, reconnecting the vehicle and the guide, and resuming installation of the cable.

Within the framework of the present invention the term "cable" is to be understood to include not only conventional cables, but also pipes, offshore umbilicals or any other elongate flexible member for which a trench might be required in a ground formation, in particular in a seabed. The cables typically have a diameter up to 40 cm, preferably in a range from 2 to 30 cm, more specifically in a range from 5 to 20 cm.

The invention will now be explained in more detail with reference to the drawings, which schematically show a preferred embodiment according to the present invention.

DETAILED DESCRIPTION OF THE INVENTION

Figure 1:
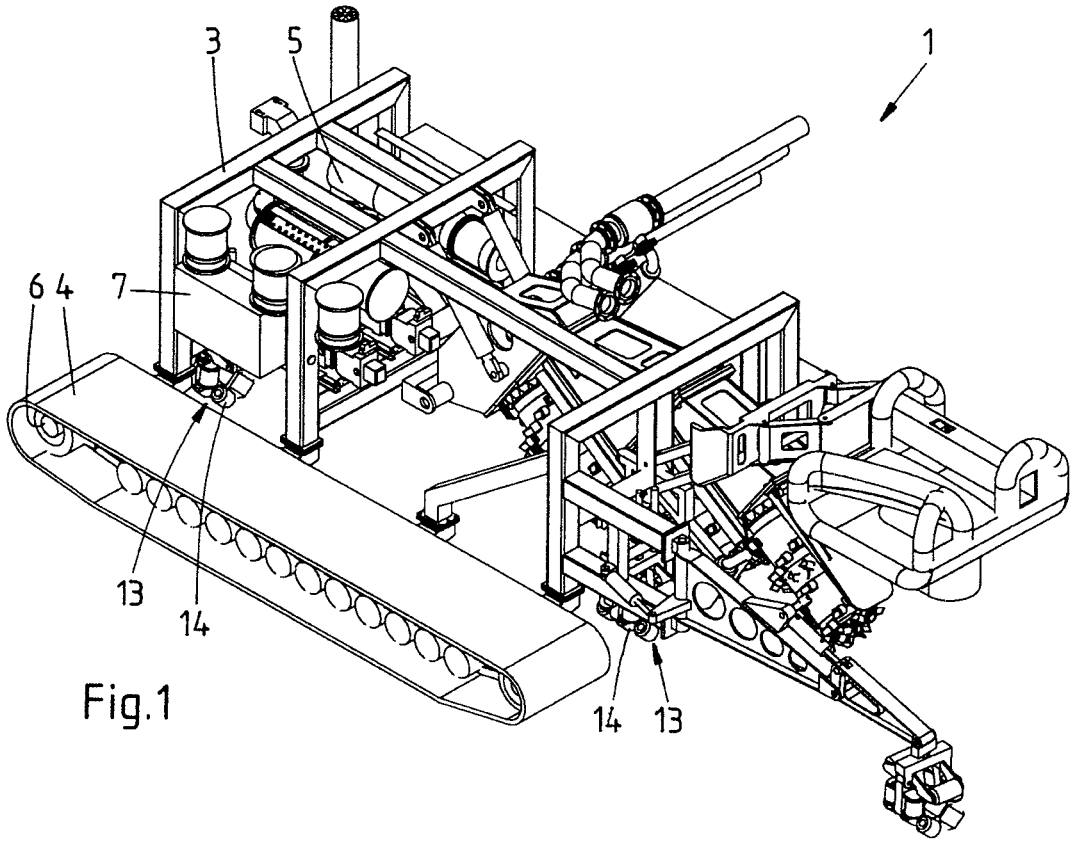
FIG. 1 is a perspective rear view of an example of a remotely operated vehicle according to the present invention.
Figure 2:
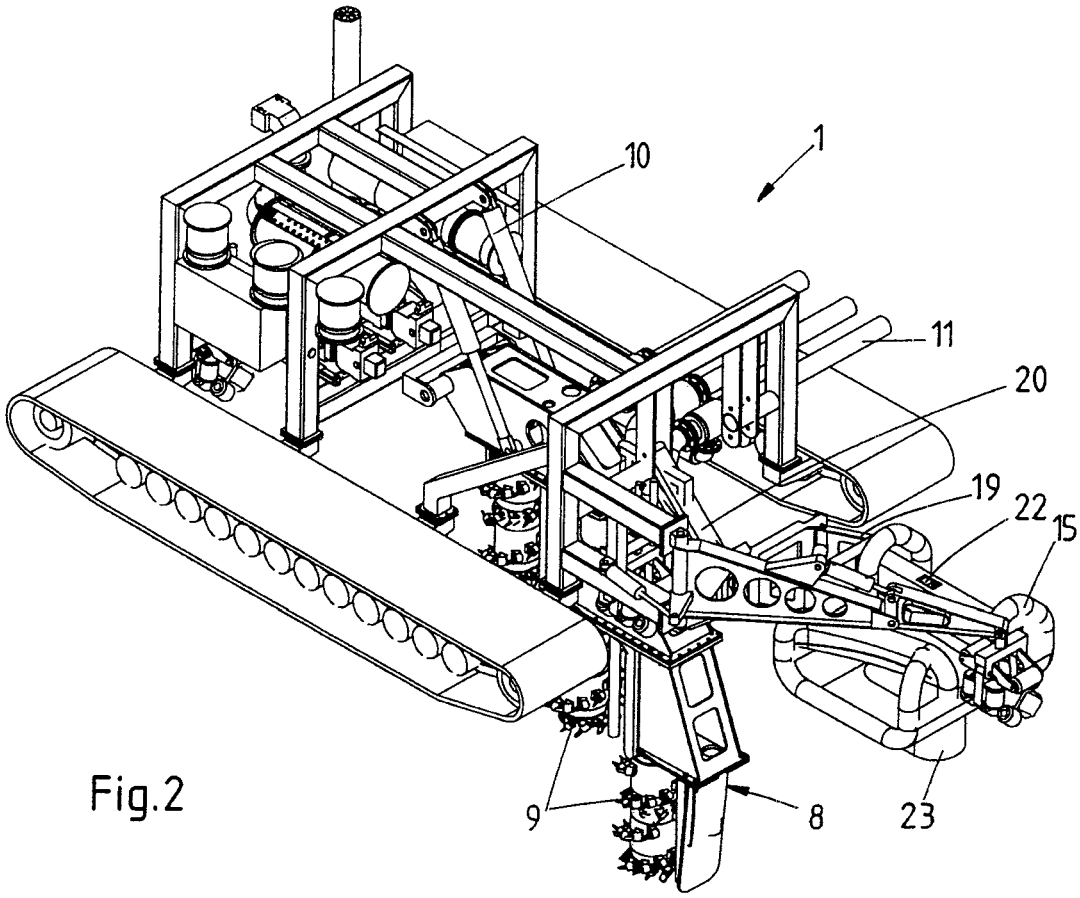
FIG. 2 is a perspective rear view of the vehicle shown in FIG. 1 with its cable guide and cutters deployed.
Figure 4:
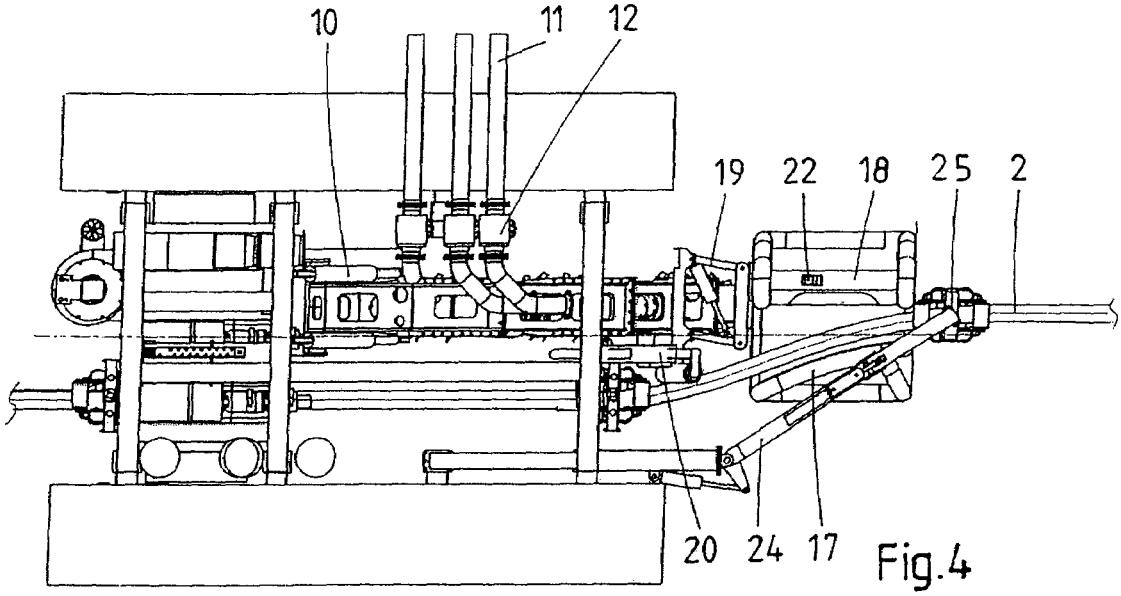
FIG. 4 is a top plan view of the vehicle in FIGS. 1 and 2 installing a cable.

FIGS. 1, 2 and 4 show a remotely operated vehicle (ROV) 1 for installing a cable 2 (shown in FIG. 4) in a seabed and connected by means of an umbilical (not shown) to a surface vessel. The vehicle 1 comprises a frame 3, two tracks 4, a powerpack 5 for converting electrical power supplied via the umbilical into hydraulic power, a hydromotor 6 for driving the tracks 4, and various auxiliary devices 7, such as e-pods, compensators, hydraulic cylinders and the like. All the said parts 4-7 are mounted in or on the frame 3.

The vehicle 1 further comprises a cutter assembly 8 for forming a trench in the seabed, which in turn comprises a plurality of rotatable cutters 9, arranged substantially side by side (in a radial direction) and staggered (in axial direction), and is pivotable about an axis extending substantially transversely to the tracks 4 and hence to the direction of movement of the vehicle 1. The cutter assembly 8 is further connected to the frame 3 by means of a pair of hydraulic cylinders 10, with which the cutter assembly 8 can be moved between an extended position (FIG. 2), in which the cutters 9 are in contact with the ground, and a retracted position. Each of the cutters 9 communicates with a discharge pipe 11 and a pump 12 for removing spoil generated by the cutters 9.

Claws 13 for grasping and guiding the cable 2 are mounted on the bottom side of the frame 3 and in between the tracks 4 (FIG. 4). To facilitate guidance of the cable 2, each claw 13 is provided with a plurality of rollers 14.

Figure 3:
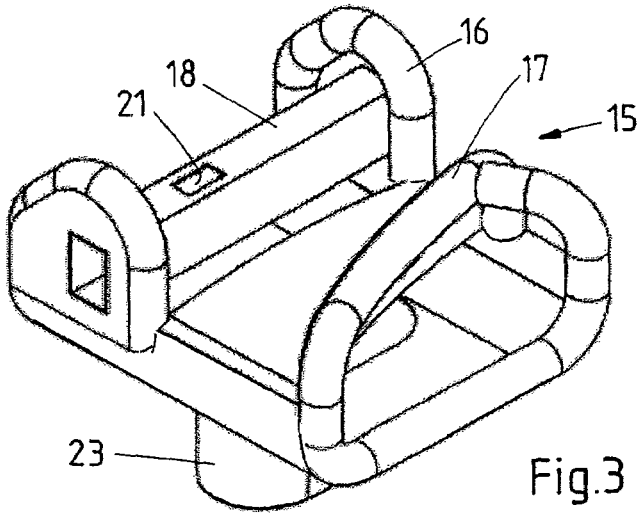
FIG. 3 is a perspective view of the (disconnected) cable guide.

A cable guide 15 is releasably connected to the vehicle 1 on or near its aft end. As shown in FIG. 3, the cable guide 15 according to this example is made from plates and, for the greater part, from tubes 16 having a relatively large diameter, thus reducing the risk of damaging the cable 2 when is placed onto the cable guide 15. The guide 15 comprises a curved wall 17 for laterally shifting the cable 2 during installation, which wall 17 has a radius of curvature of, in this example, 4 meters. The guide 15 further comprises a connector, in this example a sleeve 18 having a rectangular cross-section. The sleeve 18 serves as a socket for accommodating a rod-like connector (hidden from view by the sleeve 18) attached, by means of a parallelogram 19 and at least one pivotable arm 20, to the frame 3 of the vehicle 1. The sleeve 18 comprises passive locking means, in this example an opening 21, to allow an hydraulically operated latch 22 on the rod-like connector to interlock with the socket 18.

At its bottom side, the guide 15 is provided with a keel 23, preferably having a width less than or equal to the width of the cutters 9. Also, the guide 15 comprises a locating aid, such as a beacon, transponder or reflector, preferably placed inside one of the tubes 16.

Finally, the vehicle 1 comprises an arm 24 mounted on the frame 3, which is extendable alongside and over the guide 15 and which comprises on its distal end a claw 25, similar to the claws 13 on the lower side of the frame 3.

Installing a cable by means the vehicle 1 and guide 15 according to the present invention may comprise the steps of:

lowering the vehicle 1 carrying the guide 15 from a surface vessel, such as a sub-sea support vessel or a cable laying vessel, and positioning the vehicle 1, by means of cables or thrusters (not shown) with the opened claws 13 over the pre-laid cable 2, closing the claws 13, thus grasping and slightly lifting the cable 2, activating and lowering the cutters 9, moving the vehicle 1 along the cable 2 to form the beginning of a trench and positioning, by means of the parallelogram 19 and the arm 20, the cable guide 15 with respect to the trench and placing the keel 23 in the trench, and grasping the cable 2 by means of the arm 24 and lifting it into the guide 15.

Trenching is performed by continuously moving the vehicle 1 along the cable 2, forming a trench and sliding the cable 2 laterally over the seabed and into the trench, all simultaneously. The keel 23 under the guide 15 facilitates (passively) maintaining proper alignment with the trench. If required, the guide 15 may be positioned actively by means of the parallelogram 19 and the arm 20.

If the installation of the cable 2 must be interrupted, e.g. because of weather conditions or a malfunction of the vehicle 1 or the surface vessel from which the vehicle 1 is operated, the vehicle 1 according to the present invention is disconnected from the guide 15 and hoisted. The guide 15 is left in place, maintaining the cable 2 in its position and stabilising the trench. When the weather has improved or the malfunction has been repaired, installation is resumed by lowering the vehicle 1 to the location of the guide 15 and over the cable 2, reconnecting the vehicle 1 and the guide 15, grasping the cable 2 by means of the guide claws 13, following the trench in reverse direction thus lifting a section of the cable from the trench, activating and lowering the cutters 9, and resuming installation.

The vehicle and guide according to the present invention facilitate installing a cable in a ground formation, in particular in a seabed, as well as interrupting installation. As the guide comprises substantially no components that must be coupled to an external power source, reconnecting the vehicle and the guide is relatively straightforward.

The invention is not restricted to the above-described embodiments, which can be varied in a number of ways within the scope of the claims. For instance, the vehicle and/or the guide may be provided with means to actively urge the cable into the trench. Also, the cutter assembly may comprise or consist of jets.

The invention claimed is:

1. A vehicle for installing a cable in a seabed, comprising a frame, propulsion, a cutter assembly for forming a trench and a guide for placing the cable in the trench, wherein the guide is provided with a keel to be placed in the trench and the guide is releasably connected to the vehicle.

2. The vehicle according to claim 1, wherein the guide comprises a connector and the vehicle comprises a connector counterpart.

3. The vehicle according to claim 2, wherein one of the connector and the connector counterpart comprises an elongated member and the other of the connector and the connector counterpart comprises a socket for accommodating the elongated member.

4. The vehicle according to claim 1, wherein the guide is movable with respect to the vehicle.

5. The vehicle according to claim 4, wherein the guide is movable in a lateral direction with respect to the vehicle.

6. The vehicle according to claim 5, wherein the guide is also movable to different heights relative to the vehicle.

7. The vehicle according to claim 4, wherein the guide is movable to different heights relative to the vehicle.

8. The vehicle according to claim 1, wherein the cutter assembly includes cutters and the keel has a width less than or equal to the width of the cutters.

9. The vehicle according to claim 1, wherein the guide comprises a curved wall for laterally shifting the cable.

10. The vehicle according to claim 9, wherein the curved wall has a radius of curvature of at least 20 times the diameter of the cable.

11. The vehicle according to claim 10, wherein the curved wall has a radius of at least 4 meters.

12. The vehicle according to claim 1, comprising an arm extendable alongside and over the guide.

13. The vehicle according to claim 1, wherein the guide comprises a locating aid.

14. The vehicle according to claim 13, wherein the locating aid is one of a beacon, a transponder and a reflector.

15. A method of temporarily interrupting the installation, by means of the vehicle and guide according to claim 1, of a cable in a seabed, comprising the steps of:

disconnecting the vehicle from the guide while leaving the cable in or on the guide, hoisting the vehicle with a surface vessel and leaving the guide in position, lowering the vehicle from the surface vessel, reconnecting the vehicle and the guide, and resuming installation of the cable.

16. A method according to claim 15, further comprising the step of following the trench in a reverse direction thus lifting a section of the cable from the trench after the step of reconnecting the vehicle and the guide and prior to resuming installation of the cable.

* * * * *